US008152344B2

(12) United States Patent
Gu et al.

(10) Patent No.: US 8,152,344 B2
(45) Date of Patent: Apr. 10, 2012

(54) DOUBLE-SHAFT HINGE AND LAMP USING THE SAME

(75) Inventors: Huai-Shan Gu, Shenzhen (CN); Ting Dong, Shenzhen (CN); Wen-Hsiang Lu, Taipei Hsien (TW); Li-Tao Zhang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 184 days.

(21) Appl. No.: 12/782,720

(22) Filed: May 19, 2010

(65) Prior Publication Data

US 2011/0141737 A1 Jun. 16, 2011

(30) Foreign Application Priority Data

Dec. 14, 2009 (CN) ..... 2009 1 0311385

(51) Int. Cl.
*F21S 8/00* (2006.01)

(52) U.S. Cl. ..... 362/427; 362/428; 362/401; 16/368

(58) Field of Classification Search ..... 362/249.1, 362/427, 428, 269, 287; 16/368
See application file for complete search history.

(56) References Cited

U.S. PATENT DOCUMENTS

| | | | | |
|---|---|---|---|---|
| 7,369,414 | B2 * | 5/2008 | Kim | 361/752 |
| 7,896,568 | B2 * | 3/2011 | Atkinson | 403/62 |
| 2003/0095390 | A1 * | 5/2003 | Kim | 361/749 |

* cited by examiner

*Primary Examiner* — Ali Alavi
(74) *Attorney, Agent, or Firm* — Altis Law Group, Inc.

(57) ABSTRACT

A lamp including a double-shaft hinge, which includes at least one first rotating shaft, a second rotating shaft, an installation connector and a supporting connector connected with the installation connector, a pair of first shaft brackets and a second shaft bracket. The first shaft bracket is non-rotatably fixed with the first rotating shaft, and the second shaft bracket is non-rotatably fixed with the second rotating shaft. The installation connector defines a pair of symmetrical sleeves, the supporting connector defines a shaft hole, and the central axis of the shaft hole and the central axis of the sleeves are perpendicular to each other. The first rotating shaft are rotatably positioned in the sleeves, the second rotating shaft is rotatably positioned in the shaft hole.

12 Claims, 7 Drawing Sheets

DOUBLE-SHAFT HINGE AND LAMP USING THE SAME

BACKGROUND

1. Technical Field

The present disclosure relates to hinges and lighting devices and, particularly, to a double-shaft hinge and a lamp using the same.

2. Description of Related Art

With folding electronic devices, such as lamps, the covers are connected with the bases via a variety of linkages, and the covers are able to turn in a plurality of directions relative to the bases. However, to ensure the strength is sufficient, the designs of these link structures are often very complicated, and the volume of the structure is large.

Therefore, what is needed is a lamp with a simple structure and a small volume.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
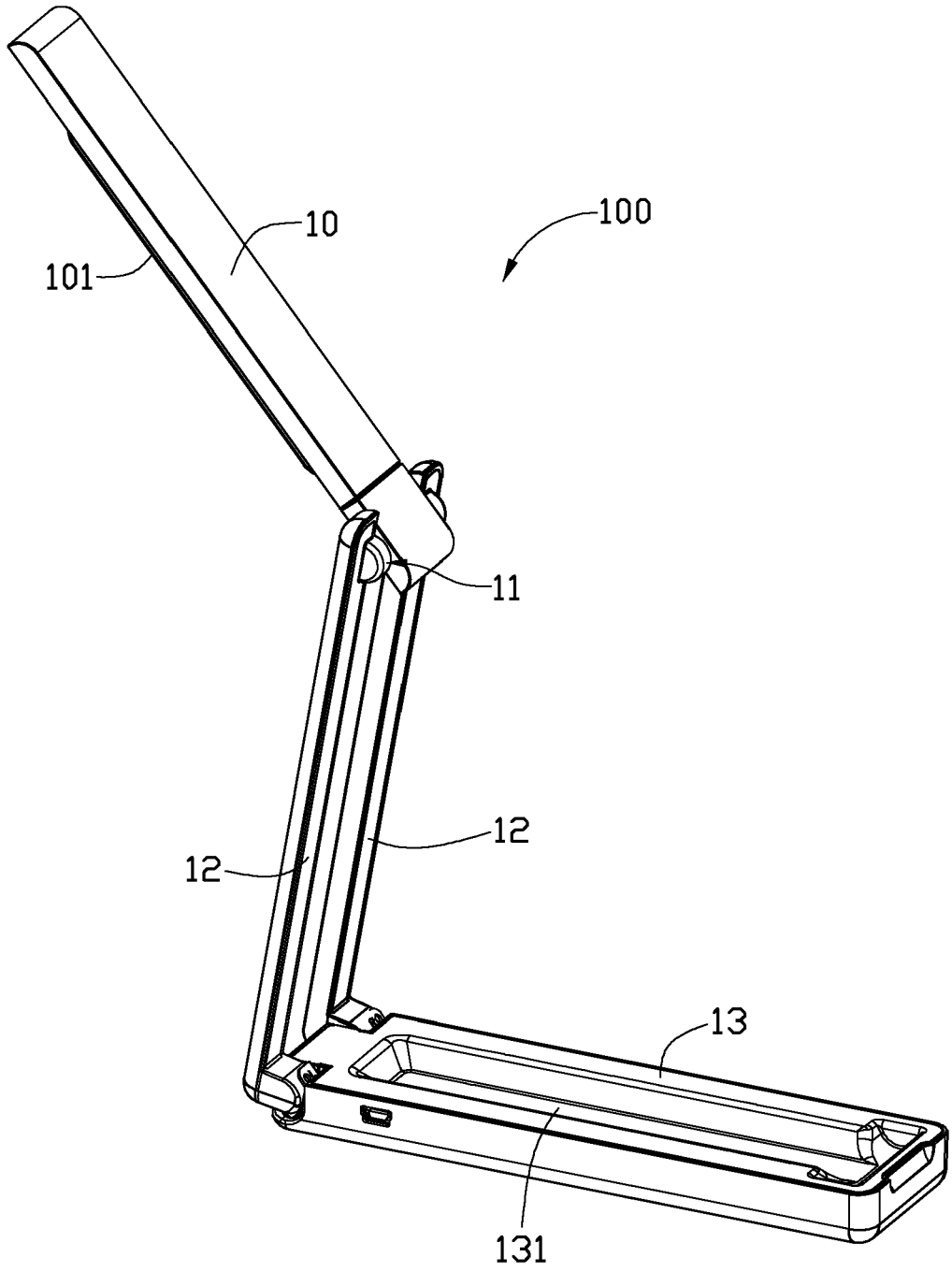
FIG. 1 is a schematic, isometric view of a lamp in an open state according to an exemplary embodiment.

Referring to FIG. 1, a lamp 100 includes a lampshade 10, a double-shaft hinge 11, a pair of supporting brackets 12 and a base 13. A plurality of light bulbs 101 are installed in the lampshade 10. In this embodiment, the light bulbs 101 are illustrated as light-emitting diodes (LEDs). The lampshade 10 is rotatably connected to one end of the supporting bracket 12 via the double-shaft hinge 11, and the base 13 is articulated to the other end of the supporting bracket 12. The supporting brackets 12 are arranged symmetrically and cooperate to define a gap therebetween. The lampshade 10 can be accommodated in the gap when it is folded.

The base 13 defines a groove 131 facing the light bulbs 101, the groove 131 is used to accommodate the light bulbs 101 and for protecting the light bulbs 101. Furthermore, the lamp 100 can be thinner when the light bulbs 101 are folded into the groove 131. A circuit board (not shown) is received in the base 13, is connected to an external power source or an internal power source, and supplies power to the light bulbs 101 via wires.

Figure 2:
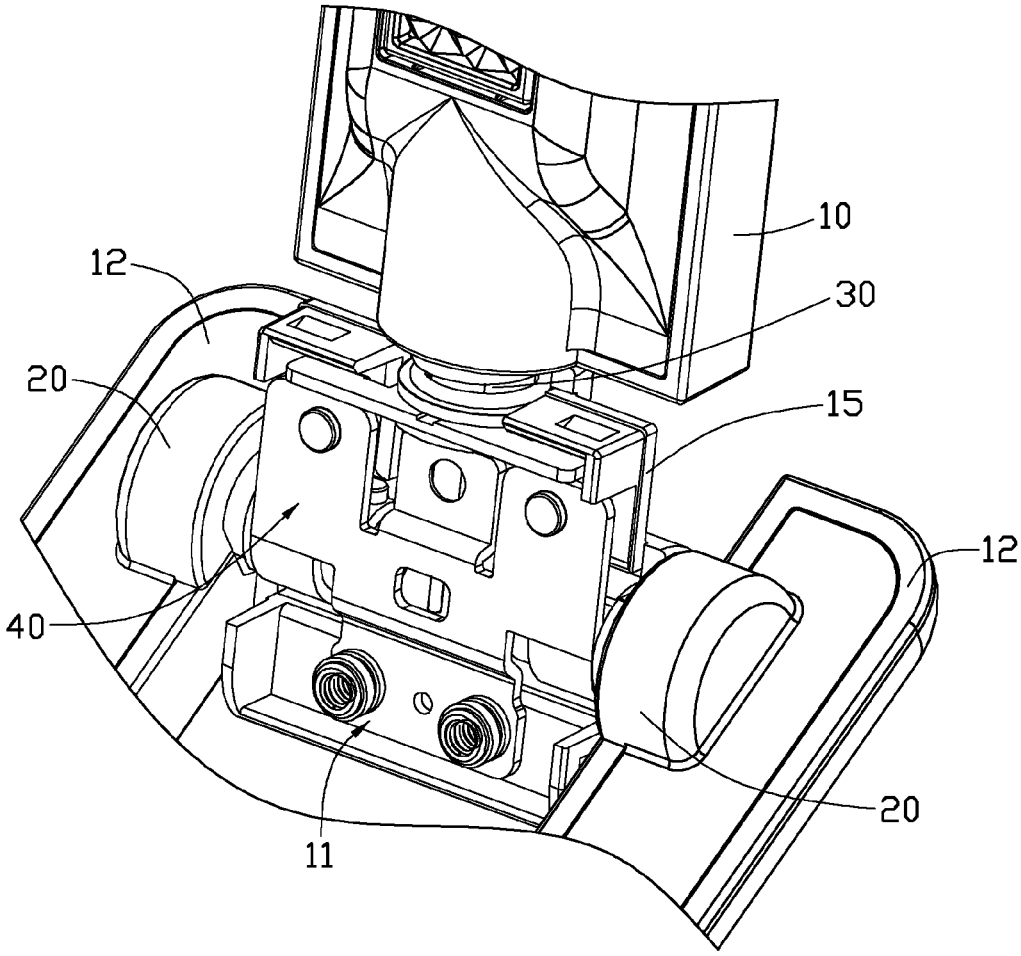
FIG. 2 is an enlarged partial view of a double-shaft hinge of the lamp of FIG. 1.

Referring also to FIG. 2, the double-shaft hinge 11 connects the lampshade 10 to the supporting bracket 12. The double-shaft hinge 11 includes a pair of first rotating shafts 20, a second rotating shaft 30, a connecting module 40. The connecting module 40 is rotatably connected to the supporting bracket 12 via the first rotating shafts 20, and is rotatably connected to the lampshade 10 via the second rotating shaft 30. The lamp 100 further includes a shell 15 which covers the connecting module 40 to make an esthetic appearance of the lamp 100.

Figure 3:
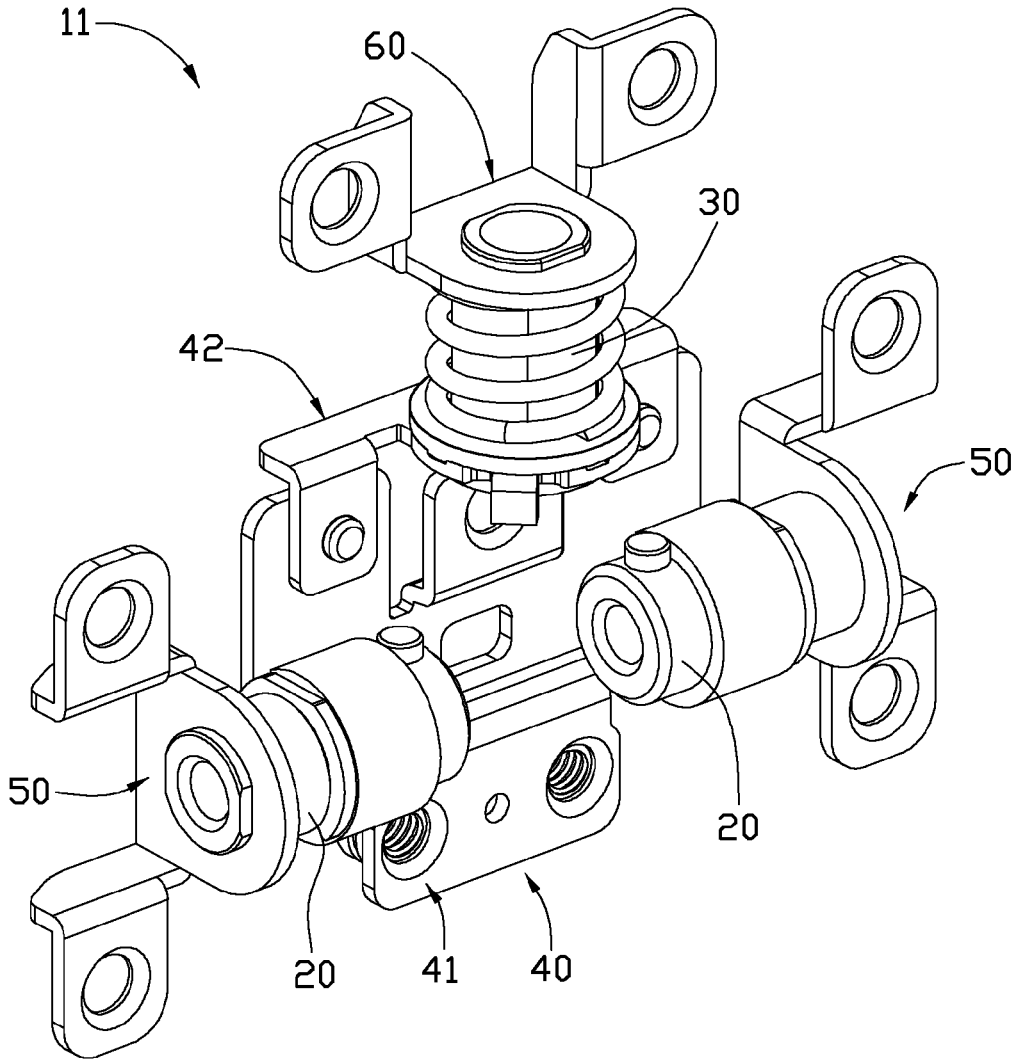
FIG. 3 is a schematic, isometric view of the double-shaft hinge of FIG. 2.

Referring to FIG. 3, the connecting module 40 includes an installation connector 41 and a supporting connector 42 connected with the installation connector 41. In this embodiment, several assembly holes are defined in the installation connector 41 and the supporting connector 42, and screws are inserted into the assembly holes to screw the supporting connector 42 to the installation connector 41.

Figure 4:
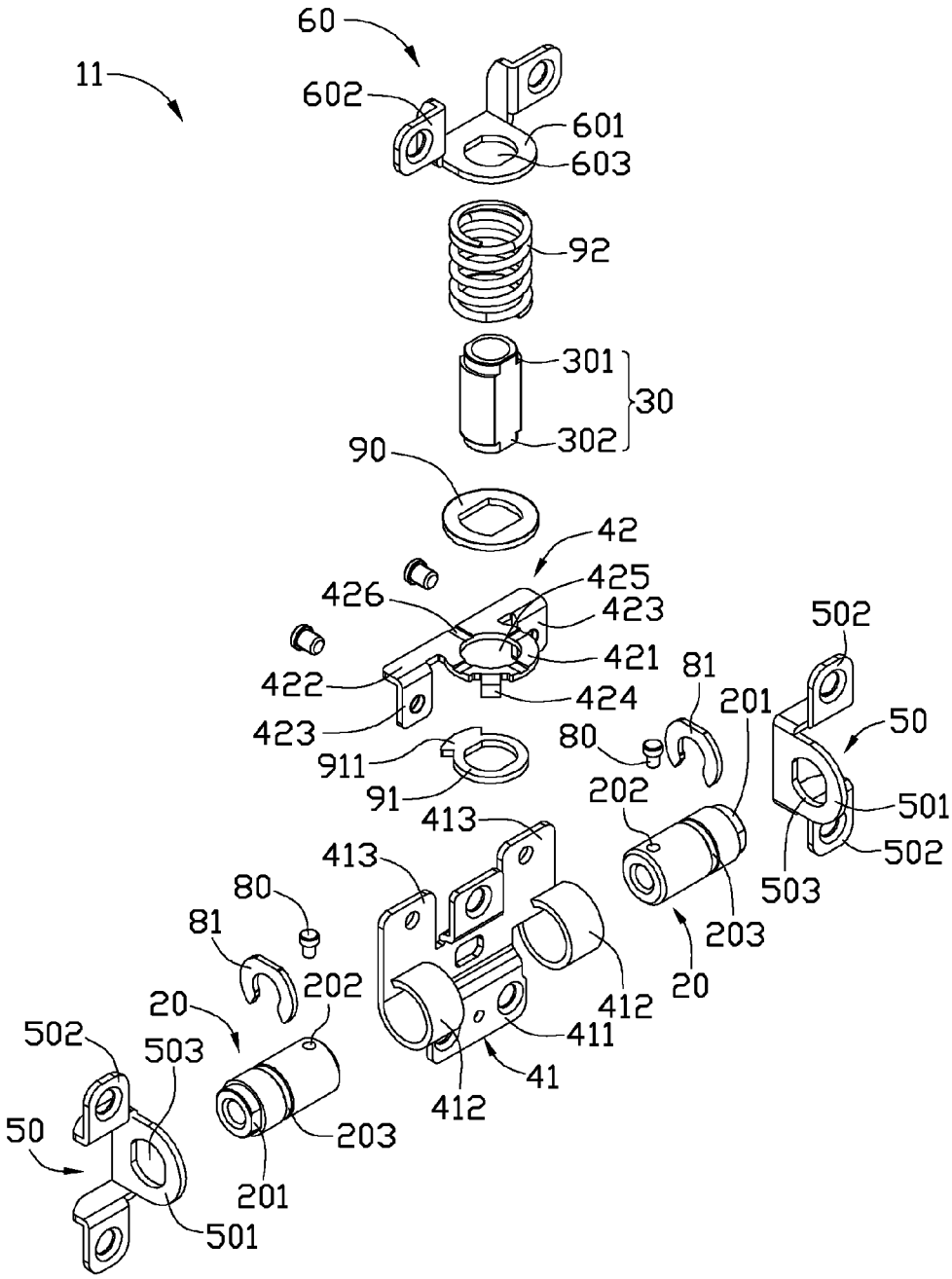
FIG. 4 is an exploded view of the double-shaft hinge of FIG. 3.

Referring to FIG. 4, the installation connector 41 includes a fixed part 411, a connecting part 413 extending from the fixed part 411, and a pair of sleeves 412 bending from two symmetrical sides of the fixed part 411. A plurality of assembly holes are defined in the fixed part 411, and screws are inserted into the assembly holes to screw the fixed part 411 to the shell 15.

The supporting connector 42 includes a bearing part 421, a bearing arm 422 extending from the edge of the bearing part 421, and a pair of tabs 423 vertically bending from the bearing arm 422. The tabs 423 cooperate with the connecting part 413. The bearing part 421 defines a round shaft hole 425. The central axis of the shaft hole 425 and the central axis of the sleeves 412 are perpendicular to each other. The bearing part 421 defines a stopper block 424 bending towards the installation connector 41, and defines a plurality of grooves 426 on a top side away from the installation connector 41. The stopper block 424 is defined at an edge of the bearing part 421. The grooves 426 are radially disposed around the shaft hole 425.

Each first rotating shaft 20 defines an axial through hole therein for the wires of the lamp 100 to pass through. The first rotating shaft 20 further defines a pinhole 202 at the end inserted into a corresponding sleeve 412. The first rotating shaft 20 includes a non-cylindrical part 201 on the other end, and defines a circumferential groove 203 between the pinhole 202 and the non-cylindrical part 201. In assembly, each first rotating shaft 20 extends through the corresponding sleeve 412, a bolt 80 is inserted into the pinhole 202, and a circlip 81 is inserted into the groove 203, thus to prevent axial movement of the first rotating shaft 20 relative to the sleeve 412. The first rotating shaft 20 is rotatable around the sleeve 412. Friction force exists between the first rotating shaft 20 and the sleeve 412, thus the first rotating shaft 20 can maintain a fixed position when no rotating force is applied to the first rotating shaft 20.

The second rotating shaft 30 defines an axial through hole therein for the wires of the lamp 100 passing through. Both ends 301 and 302 of the second rotating shaft 30 are non-cylindrical shaped.

The double-shaft hinge 11 further includes an elastic gasket 90, a limiting gasket 91 and an elastic element 92. The elastic gasket 90 is a ring plate with a non-circular central hole for non-rotatably receiving the non-cylindrical end 302.

Figure 5:
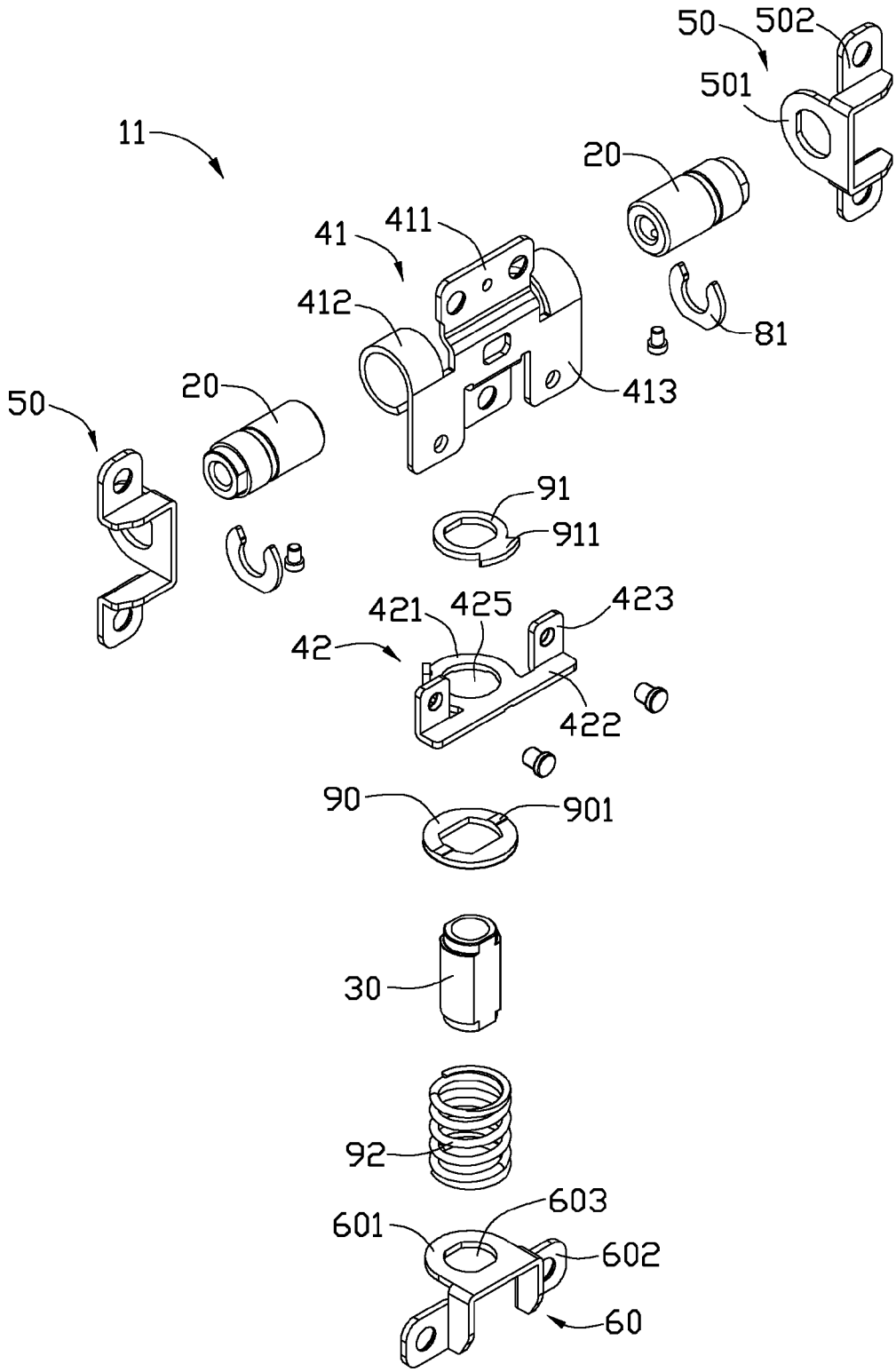
FIG. 5 is another exploded view similar to FIG. 4, but viewed from a different aspect.

Referring to FIG. 5, the elastic gasket 90 defines a pair of radial projections 901 on an end surface facing to the bearing part 421. The projections 901 are accommodated in the grooves 426. In this embodiment, the elastic element 92 is a spring and is placed around the outer surface of the second rotating shaft 30 between the non-cylindrical end 301 and the non-cylindrical end 302.

The limiting gasket 91 is a ring plate with a non-circular central hole for non-rotatably receiving the non-cylindrical end 302, and defines a fan-shaped knob 911 at an outer edge thereof. The non-cylindrical end 302 extends through the central hole of the elastic gasket 90, the shaft hole 425, and the non-circular central hole of the limiting gasket 91 in turn. Therefore, the second rotating shaft 30 is rotatable around the shaft hole 425.

The double-shaft hinge 11 further includes a pair of first shaft brackets 50 and a second shaft bracket 60. The first shaft bracket 50 includes a bearing part 501 and a pair of fixed parts 502 vertically extending from two symmetrical sides of the bearing part 501. The bearing part 501 defines a non-circular shaft hole 503, the non-cylindrical part 201 is inserted into the shaft hole 503, therefore, the first shaft bracket 50 is non-rotatably fixed with the first rotating shaft 20. The fixed part 502 defines an assembly hole for inserting a screw, thus the first shaft bracket 50 is screwed to the supporting bracket 12.

The second shaft bracket 60 includes a bearing part 601 and a pair of fixed parts 602 vertically extending from two symmetrical sides of the bearing part 601. In this embodiment, the structure of the second shaft bracket 60 is similar to the structure of the first shaft bracket 50. The bearing part 601 defines a non-circular shaft hole 603, the non-cylindrical end 301 is inserted into the shaft hole 603, therefore, the second shaft bracket 60 is non-rotatably fixed with the second rotating shaft 30.

After assembly, the spring 92 presses firmly against the elastic gasket 90, and pushes the elastic gasket 90 to resist on an end surface of the supporting connector 42, and the projections 901 are inserted into the grooves 426. Thus the second rotating shaft 30 can maintain a fixed position when no rotating force is applied to the second rotating shaft 30.

Figure 6:
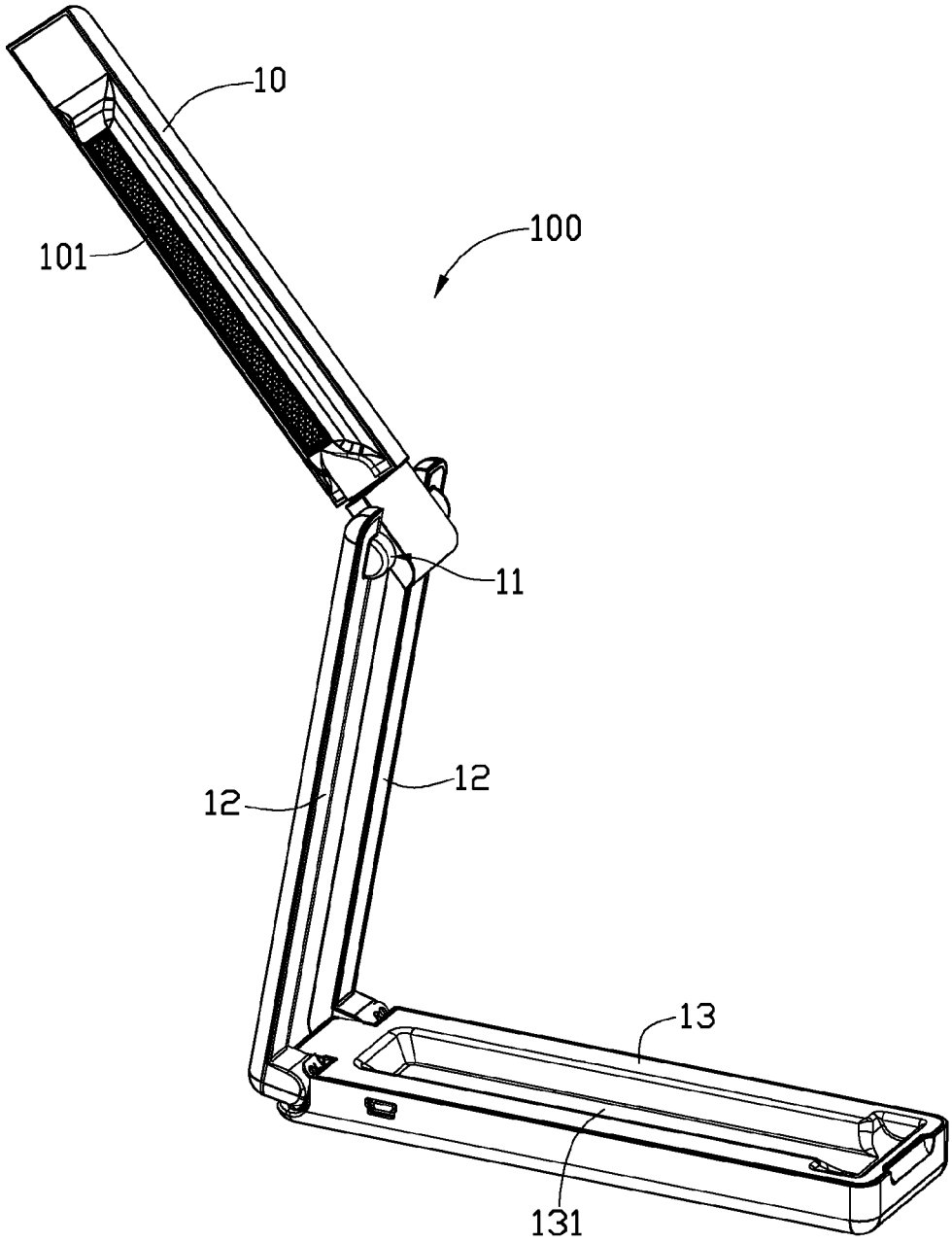
FIG. 6 is a schematic, isometric view of the lamp with the light facing a lateral side.

Referring also to FIG. 6, the second rotating shaft 30 rotates relative to the supporting connector 42 when rotation force is applied, thus the light coverage of the lamp 100 can be adjusted. When the second rotating shaft 30 rotates, the elastic gasket 90 and the limiting gasket 91 are rotated as well. When the generally fan-shaped knob 911 which could be a truncated sector, is defied by the stopper block 424, the second rotating shaft 30 cannot rotate further, therefore, the rotation scope of the second rotating shaft 30 is limited.

The lampshade 10 is rotated around the first rotating shaft 20, thus, the light coverage of the lamp 100 can be adjusted.

Figure 7:
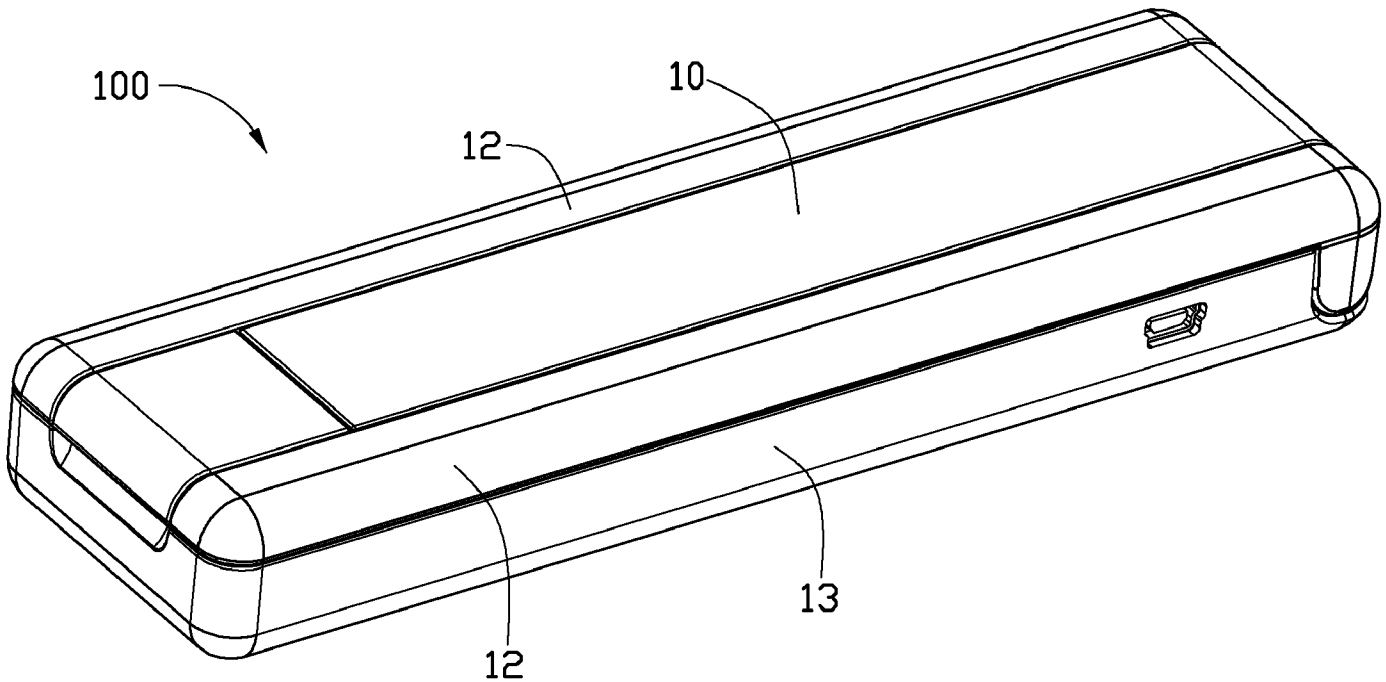
FIG. 7 is a schematic, isometric view of the lamp in a folded and closed state.

When folding the lamp 100, the lampshade 10 is rotated to be accommodated in the gap between the supporting brackets 12, and then the supporting brackets 12 are rotated together with the base 13. Thus, the light bulbs 101 are accommodated in the groove 131. The lamp 100 is folded as the convenient shape shown in FIG. 7, making the lamp portable.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A double-shaft hinge comprising:

a connecting module comprising:

an installation connector defining a pair of symmetrical sleeves; and a supporting connector connected with the installation connector, wherein the supporting connector defines a shaft hole, and the central axis of the shaft hole and the central axis of the sleeves are perpendicular to each other;

at least one first rotating shaft rotatably positioned in the sleeves;

a second rotating shaft rotatably positioned in the shaft hole;

a pair of first shaft brackets non-rotatably fixed with the first rotating shaft; and a second shaft bracket non-rotatably fixed with the second rotating shaft.

2. The double-shaft hinge of claim 1, wherein the at least one first rotating shaft defines a pinhole at an end inserted into the sleeve and a circumferential groove between the pinhole and the other end; the pinhole is inserted with a bolt and the groove is inserted with a circlip to prevent axial movement of the first rotating shaft relative to the sleeve.

3. The double-shaft hinge of claim 1, further comprising an elastic gasket and an elastic element, wherein the elastic gasket defines a non-circular central hole for non-rotatably receiving the second rotating shaft, and the elastic element is placed around the second rotating shaft, presses firmly against the elastic gasket and pushes the elastic gasket to resist on an end surface of the supporting connector.

4. The double-shaft hinge of claim 1, further comprising a limiting gasket with a non-circular central hole for non-rotatably receiving the second rotating shaft, wherein the limiting gasket comprises a fan-shaped knob at an outer edge thereof, the supporting connector comprises a stopper block bending at an edge thereof towards the installation connector, the fan-shaped knob is defied by the stopper block to limit the rotation scope of the second rotating shaft.

5. The double-shaft hinge of claim 1, wherein the supporting connector defines a plurality of radial grooves on a top side away from the installation connector, the elastic gasket comprises a pair of radial projections on an end surface facing to the bearing part, and the projections are accommodated in the grooves.

6. A lamp comprising:

a double-shaft hinge;

a pair of supporting bracket;

a lampshade rotatably connected to one end of the supporting bracket via the double-shaft hinge; and a base articulated to the other end of the supporting bracket;

wherein the double-shaft hinge comprises:

a connecting module comprises:

an installation connector defining a pair of symmetrical sleeves; and a supporting connector connected with the installation connector, wherein the supporting connector defines a shaft hole, and the central axis of the shaft hole and the central axis of the sleeves are perpendicular to each other;

at least one first rotating shaft rotatably positioned in the sleeves;

a second rotating shaft rotatably positioned in the shaft hole;

a pair of first shaft bracket non-rotatably fixed with the first rotating shaft; and a second shaft bracket non-rotatably fixed with the second rotating shaft.

7. The lamp of claim 6, wherein the at least one first rotating shaft defines a pinhole at an end inserted into the sleeve and a circumferential groove between the pinhole and the other end; the pinhole is inserted with a bolt and the groove is inserted with a circlip to prevent axial movement of the first rotating shaft relative to the sleeve.

8. The lamp of claim 6, further comprising an elastic gasket and an elastic element, wherein the elastic gasket defines a non-circular central hole for non-rotatably receiving the second rotating shaft, and the elastic element is placed around the second rotating shaft, presses firmly against the elastic gasket and pushes the elastic gasket to resist on an end surface of the supporting connector.

9. The lamp of claim 6, further comprising a limiting gasket with a non-circular central hole for non-rotatably receiving the second rotating shaft, wherein the limiting gasket comprises a fan-shaped knob at an outer edge thereof, the supporting connector comprises a stopper block bending at an edge thereof towards the installation connector, the fan-shaped knob is defied by the stopper block to limit the rotation scope of the second rotating shaft.

10. The lamp of claim 6, wherein the supporting connector defines a plurality of radial grooves on a top side away from the installation connector, the elastic gasket comprises a pair of radial projections on an end surface facing to the bearing part, and the projections are accommodated in the grooves.

11. The lamp of claim 6, wherein the supporting brackets are arranged symmetrically and cooperate to define a gap therebetween; the lampshade is accommodated in said gap when it is folded.

12. The lamp of claim 6, wherein a plurality of light bulbs are installed in the lampshade, the base defines a groove facing the light bulbs, and the groove is used to accommodate the light bulbs.

* * * * *